US006186597B1

(12) United States Patent
Hahn et al.

(10) Patent No.: US 6,186,597 B1
(45) Date of Patent: Feb. 13, 2001

(54) PICK SYSTEM FOR MINING PLOUGHS, IN PARTICULAR COAL PLOUGHS

(75) Inventors: Detlef Hahn; Peter Wollenhaupt, both of Lünen; Ernst Heiderich, Hohenroda; Georg Marker, Grossenlüder; Peter Richter, Essen; Wolfgang Wald, Rasdorf; Reinhold Walter, Rossdorf, all of (DE)

(73) Assignee: DBT Deutsche Bergbau-Technik GmbH, Lunen (DE)

( * ) Notice: Under 35 U.S.C. 154(b), the term of this patent shall be extended for 01 day.

(21) Appl. No.: 09/236,972

(22) Filed: Jan. 26, 1999

(30) Foreign Application Priority Data

Jan. 29, 1998 (DE) ..... 198 03 383
Dec. 17, 1998 (DE) ..... 198 58 281

(51) Int. Cl.[7] ..... E21C 35/18
(52) U.S. Cl. ..... 299/109; 299/102
(58) Field of Search ..... 299/102, 103, 299/108, 109, 34.04; 37/454

(56) References Cited

U.S. PATENT DOCUMENTS 3,305,274 * 2/1967 Goodfellow, Jr. et al. ..... 299/109

FOREIGN PATENT DOCUMENTS 1 291 708 11/1969 (DE) .
25 38 682 1/1983 (DE) .
31 22 868 6/1986 (DE) .
35 31 781 1/1987 (DE) .
38 06 363 4/1989 (DE) .
41 02 140 7/1992 (DE) .
34 40 448 10/1992 (DE) .
41 05 238 1/1993 (DE) .
44 31 701 9/1996 (DE) .

* cited by examiner

*Primary Examiner*—David Bagnell
*Assistant Examiner*—Sunil Singh
(74) *Attorney, Agent, or Firm*—Vickers, Daniels & Young

(57) ABSTRACT

In the plough pick arrangement according to the invention for mining ploughs or coal ploughs, the plough pick is held in the socket of a pick holder. On that side of the pick holder which is leading in the working direction of the plough pick a pick lead-through opening is provided through which the pick can be inserted by its shank until it reaches a rear stop and is retained by a securing device. The pick can be removed from the socket through the same opening, after the securing device has been released, when pick replacement is necessary. This makes it possible to insert the pick into and remove it from the pick holder, not from the working side, but from the front of the holder. The pick holder and the pick are preferably provided with co-operating bearing and guiding faces which are inclined at an oblique angle to a plane parallel with the working face so that the cutting bit of the pick moves away from the working face when the pick is removed.

34 Claims, 6 Drawing Sheets

FIG.2
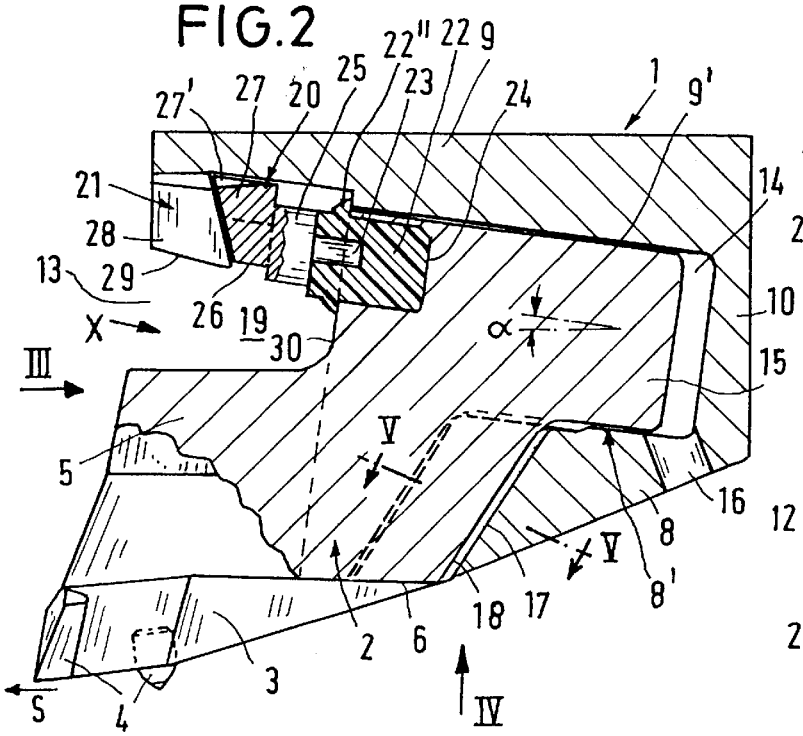
FIG.3
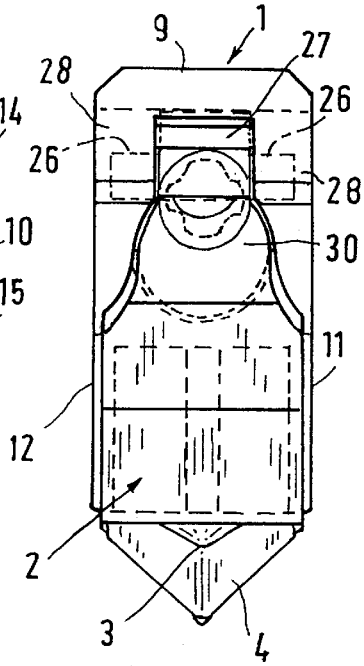
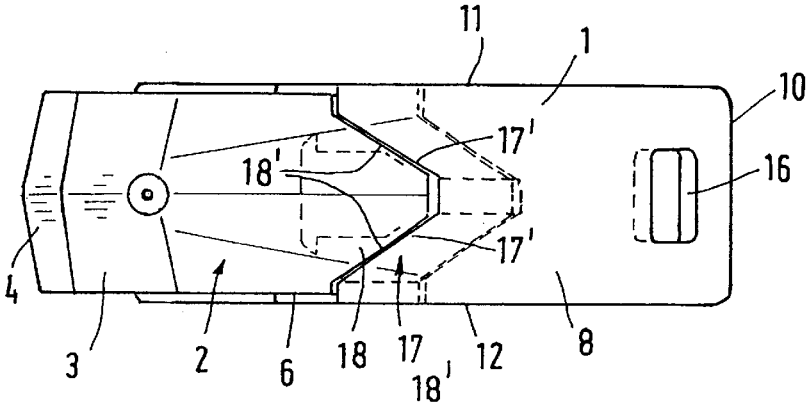
FIG.4
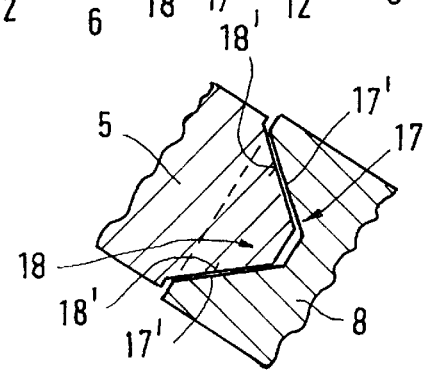
FIG.5

PICK SYSTEM FOR MINING PLOUGHS, IN PARTICULAR COAL PLOUGHS

FIELD OF THE INVENTION

The invention relates to a pick system for mining ploughs, in particular coal ploughs, of the kind comprising at least one pick holder arranged on the plough head or on a pick carrier thereon, and a replaceable plough pick insertable by its shank into a matching socket in the pick holder in which it is held, with rear end support and with an interference fit, in its working position with its cutting tip projecting from the socket on the working side and in which it is secured against detachment by a securing element which can be displaced from a locking position when the pick is to be replaced.

BACKGROUND OF THE INVENTION

Coal ploughs used successfully for many years in underground long wall face workings have pick holders arranged on the plough heads, usually on pick carriers pivotally mounted thereon, and provided with sockets into which the plough picks can be inserted by their shank, which is usually flat-sided. The shanks of plough picks which are known and in common use are matched in its conformation and dimensions to the shape and size of the sockets in which they are inserted, so that the picks are held in the sockets of the pick holders with their shanks in form-fitting engagement. To stop the picks from coming out of their holders in the opposite direction to their insertion direction when the plough is in operation, when the plough performs its working motion in the opposite direction to its cutting direction, it is necessary to provide some means of securing the picks in their sockets. Numerous such means have been proposed, e.g. locking pins, studs, and bolts; retaining keys; collets secured with heavy duty dowel pins or screws, etc. (DE-PS 1291708, DE 2538682 C2, DE 3440448 C2, DE 3531781 C1, DE 3122868 C2, DE 3806363 C2, DE 4105238 C2, DE 4431701 C2).

In the known plough pick systems commonly used in mining for many years, the pick holders are invariably designed so that the picks have to be inserted by their shanks into the sockets from the working or coal face side, and must be removed from the sockets in the pick holders towards that side, after the securing elements have been released, when pick replacement is necessary. Frequently the clearance needed for this operation between the plough, or its picks, and the coal face is available only at the end of a long wall face.

The known plough pick systems commonly used in the mining industry usually require, besides the securing elements used as loose parts, additional fastening elements for fixing the securing elements in the locked position. Such fastening elements include, among others, elastic clamps, plastic plugs provided with steel pins, clamping collets and screws, etc. The result of using such additional fastening elements is that production costs, and consequently plant costs, are increased. In many cases the known systems are difficult to handle when picks are being inserted or replaced, and/or are unreliable in service so that losses of picks while the plough is operating are not uncommon. One known system uses securing elements consisting of captive spring-mounted plunger pins on the pick which automatically snap into the locked position upon insertion of the pick into the holder (DE 4102140 A1). Here again the picks must be inserted into the pick holders from the working side, and removed towards that side.

Taking as its starting-point a plough pick system of the kind initially referred to, the invention has the basic object of providing a pick arrangement, suitable for use in mining, which can be handled more easily when the pick is inserted into the holder, and also when the pick is being removed for replacement.

SUMMARY OF THE INVENTION

In accordance with the invention, the pick holder has, on the side leading in the working direction of the pick, a pick lead-through opening through which the pick is insertable by the shank as far as a rear stop in the pick holder socket and through which the pick is removable, after the securing element has been unlocked, when it is to be replaced.

With the pick system configuration according to the invention, the pick can be inserted into the socket in the pick -holder not from the working side as in the past, but from the side which is at the front in the direction of cutting, through the pick lead-through opening provided on that side, and removed in the opposite direction via the said lead-through opening when replacement is necessary. The job of inserting the picks into the pick holders, and also that of replacing the picks, is made much easier, as increased clearance between the picks and the working face is not required; instead, the clearance usually present in front of the pick holders can be utilized. Production can also be simplified in a number of ways with the configuration of pick holders according to the invention, with the form-fitting seating and support of the picks in their sockets. Matters can be advantageously arranged so that the front lead-through opening in the pick holder is extended to form an opening in the pick holder on the working side from which the pick's cutting tip can project.

In accordance with another important feature of the invention, the interior of the socket in the pick holder has at least one shank bearing and guiding surface which is inclined at an oblique angle to a plane parallel with the cutting direction, so that when the pick is removed from the lead-through opening its outlying cutting tip is moved away from the working face. With this embodiment of the pick system, when the pick is removed for replacement it is guided forwards by the pick holder in a constrained manner, causing its outlying tip to move away from the working or mining face, so that the pick can be replaced easily and quickly even if its cutting tip is in close proximity to the working face. Conversely, this feature also facilitates insertion of the pick into the socket. It is advisable that the said bearing and guiding surface in the socket, and the side face of the pick shank which is guided by this surface on insertion and removal of the pick, be set at an oblique angle of some 5° to 20°, preferably 5° to 10°, to a plane parallel with the cutting direction.

As is customary in known plough picks, which, like those according to the invention, are, as a general rule, designed for one-sided cutting, the pick provided in the system according to the invention is held by its shank in the pick holder socket in a form-fitting manner, and is supported at the rear by the pick holder against the cutting forces occurring in operation. In another advantageous configuration of the invention, the pick shank has a rear supporting and guiding extension engaging in a recess in the pick holder socket in which the shank is held in a form-fitting manner, and the axis of the recess in the socket and that of the supporting and guiding extension engaging therein are inclined at the abovementioned oblique angle. The tenon-like supporting and guiding extension fixedly and integrally arranged on the shank of the pick according to the invention positively locks the pick in the pick holder in the transverse direction, and also serves to guide the pick on its insertion or replacement. The supporting and guiding extension may be given some other cross-section, for example a round cross-section, or alternatively a flattened segmental cross-section. In each case, the said socket recess is adapted to the cross-section of the supporting and guiding extension.

A particularly advantageous embodiment of the invention is obtained if the pick shank and/or the supporting and guiding extension has a conical taper, or when viewed in plan narrows trapezoidally, from its front region towards its rear end. In this self-centring embodiment the side surfaces of the pick shank and/or of its supporting and guiding extension do not make full-face contact with the surrounding surfaces until the end of the insertion movement, which greatly facilitates insertion of the pick.

Rear-end support of the pick inside the pick holder may be provided through-the said supporting and guiding extension. However, in a preferred arrangement, the supporting surface is a holder wall end face forming the rear-end boundary of the opening for the cutting tip. The rear face of the pick bears against this supporting surface, which absorbs the cutting forces acting on the pick during operation. To create favourable bearing conditions, the said rear face and the supporting surface may usefully be formed as angled faces which are coplanar and extend transversely across the cutting direction of the pick. The said supporting surface at the working-side side-wall of the pick holder may extend inwards as far as the abovementioned socket recess. In a further advantageous construction, the supporting surface is formed by the inwards converging flanks of a V-groove, the rear face of the pick shank being formed as a tongue matching the V-groove. With the abovementioned geometrical arrangements, it is possible to obtain relatively large areas of supporting surface on shank and holder, allowing the cutting force acting on the pick during operation to be transmitted without exerting excessive pressure per unit of area on the pick holder.

Various kinds of securing elements can be used for securing the pick in the holder, such as for example the locking pins, studs, keys, etc. which are already known for this function. Preferable to securing elements in the form of loose parts, however, are securing elements which form an integral part of the pick and can be inserted into the pick holder together with the pick. Again there are various possible means of securing the pick. In one advantageous embodiment of the invention, the pick securing means is in the form of a snap-in latch element which is preferably arranged on the front of the pick, or its shank, and is elastically deflectable from its latched position, which forms the locked position, to the unlocked position, and vice versa. Advantageous configurations of such a pick securing means designed as a snap-in locking device, and also further advantageous configurations of the pick arrangement according to the invention, are disclosed in individual claims.

The invention will now be described in detail with reference to the embodiment shown by way of example in the drawings.

BRIEF DESCRIPTION OF THE DRAWINGS

FIG. 2 shows the pick system of FIG. 1 in horizontal section;

FIG. 3 shows the pick system of FIGS. 1 and 2 viewed in the direction of arrow III in FIG. 2;

FIG. 4 shows the pick system of FIGS. 1 to 3 as viewed from the working or coal face in the direction of arrow IV of FIG. 2;

FIG. 5 shows a partial section on the line V—V of FIG. 2;

DESCRIPTION OF THE PREFERRED EMBODIMENTS

Figure 1:
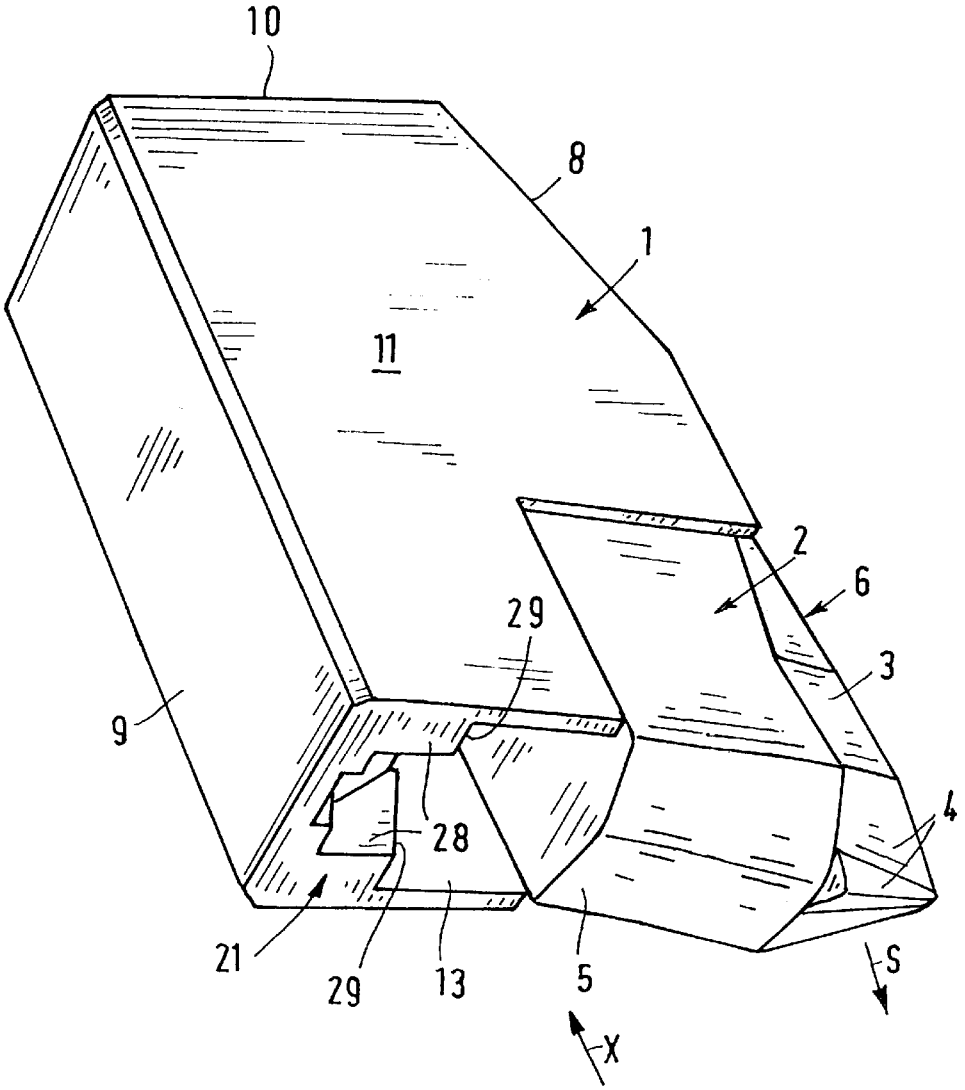
FIG. 1 is a simplified perspective overall view of a plough pick system according to the invention.

The pick system shown in the drawing comprises, in the usual way, a pick holder 1 permanently attached, e.g. by welding, to the plough head (not shown) or, preferably, to a pick carrier on the plough body, and a plough pick 2, removably fitted to the pick holder 1 with an interference fit. The pick holder 1 is preferably arranged on a pick carrier (not shown) which is pivotally mounted on the plough body so that, depending on the direction of travel of the plough, it is able to tilt from the extended position in which the pick 2 performs a ploughing operation to a retracted position in which the pick does not do any ploughing work. The plough pick 2 is, therefore, designed for cutting in one direction only. It consists, in a known manner, of a cutting tip 3 which has a carbide insert 4 and projects outside the pick holder 1, and a shank 5 with which it engages in a socket 7 in the pick holder 1 and is releasably locked therein.

Details of the first embodiment of the pick arrangement are indicated primarily in FIGS. 2 to 11. In FIG. 2 the cutting direction of the plough pick 2 during the ploughing operation is indicated by the arrow S. The pick holder 1, which is preferably formed as a one-piece metal formed part or casting, has on its working or coal mining face side an opening 6. The pick 2, when held in its working position in the pick holder 1 projects, with its cutting tip 3, from the socket 7 (FIG. 6) in the pick holder through the opening 6 and towards the working or mining face, this opening 6 being located on the pick holder 1 at the front end of the working-side side-wall 8. The side-wall 8 therefore extends over only part of the length of the pick holder, whereas the inner side-wall 9 facing away from the working face extends over the whole length of the pick holder, and the two side-walls 8 and 9 are integrally joined by the rear wall 10 and by parallel upper and lower walls 11 and 12. On the side of the pick holder 1 which is the leading side in the cutting direction S, the pick holder 1 has a pick lead-through opening 13 through which the pick 2 can be inserted by its shank 5, which carries the cutting tip 3, into the socket 7 in the pick holder in the direction of the arrow X until a rear stop is reached, and through which it can be removed from the socket 7 in the opposite direction when replacement is necessary. As is shown especially by FIGS. 1, 2 and 6, the front lead-through opening 13 in the pick holder 1 extends as far as the opening 6 provided on the working side of the pick holder to expose the cutting tip 3 of the pick 2, the two openings 6 and 13 being arranged at an angle to one another, and thus together forming a corner opening in the pick holder 1.

The socket 7 in the pick holder and the shank 5 of the pick 2 are matched to one another in their shape and dimensions so that when the pick 2 is inserted in the pick holder 1 it is held in the socket 7 in a form-fitting manner but with the necessary play. The socket 7 has a pocket-form recess 14 in its rear region between the side-walls 8 and 9 of the pick holder 1. A rearward supporting and guiding extension 15 of the shank 5 of the pick 2 engages in a form-fitting manner in the recess 14, thus positively locking the pick 2 in the socket 7 of the pick holder 1 transversely. In the arrangement proposed here, the side walls 11,12 of the pocket recess 14, and also the side walls of the supporting and guiding extension 15, are tapered in section in the manner of a trapezium from the front region of the pick (on the left in FIG. 2) to the rear end in the region of the rear wall 10, so that when the pick is inserted into the pick holder, there is adequate play during assembly, and full-area contact between the supporting and guiding extension and the side-walls of the pocket recess 14 is not obtained until insertion is complete. The pocket-form recess 14 is enclosed at its bottom end by the rear wall 10 of the pick holder 1. In its rear, bottom end, region it has a fine coal discharge opening 16, which in the illustrated example is located at the bottom end of the working-side side-wall 8, and through which any dirt getting into the recess 14, such as fine coal for example, can run out, or can be freed and cleared from the recess 14 with the aid of a spiked tool inserted into the dirt discharge opening 16 from outside.

Figure 6:
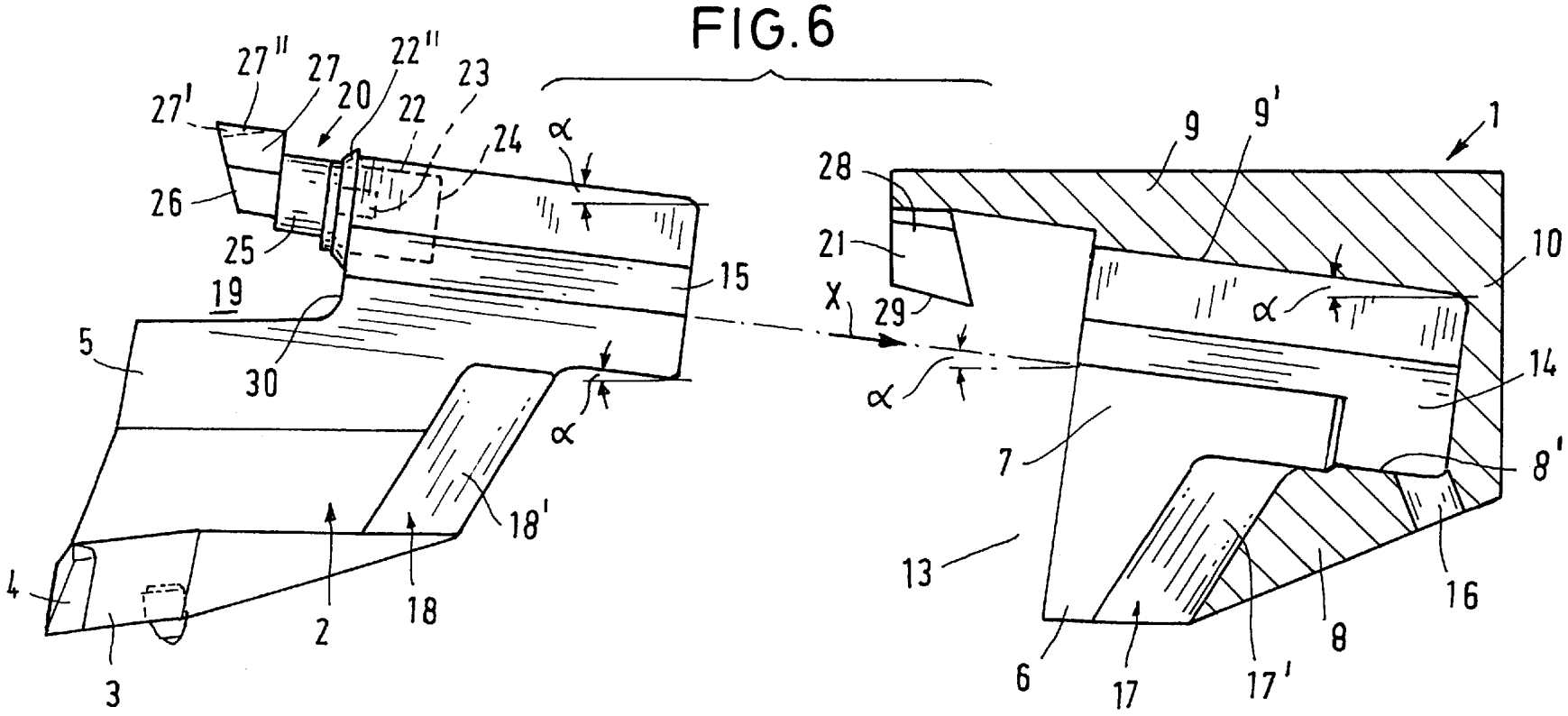
FIG. 6 shows the pick holder according to the invention in the same sectional view as FIG. 2, but with the pick separated from its holder.
Figure 7:
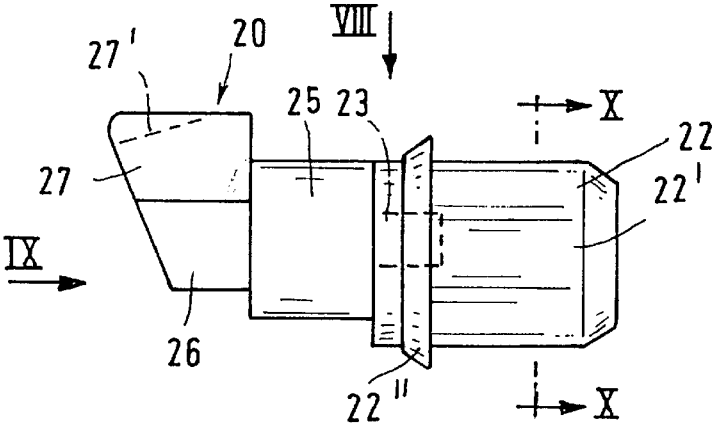
FIG. 7 is a side view, on a larger scale, of the securing element provided in the pick system of FIGS. 1 to 6 for securing the pick in its holder.
Figure 8:
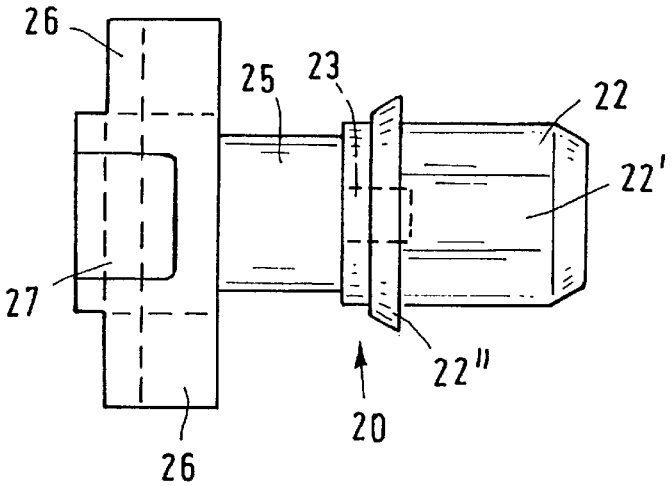
FIG. 8 is a top view of the securing element of FIG. 7.
Figure 9:
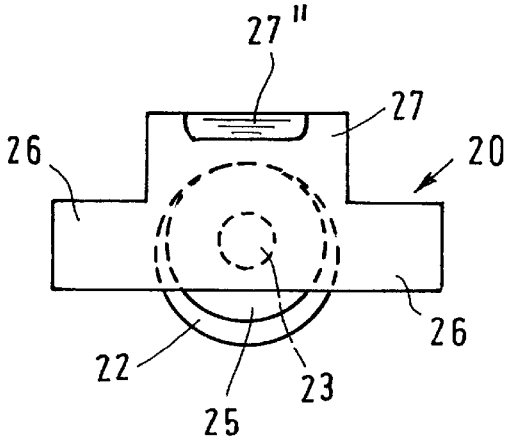
FIG. 9 shows the securing element of FIGS. 7 and 8 viewed in the direction of arrow IX of FIG. 7.

As is shown especially by FIGS. 2 and 6, the plough pick 2 in the first embodiment, viewed in plan, has an approximately S-shaped or Z-shaped contour, with one arm formed by the supporting and guiding extension 15, and the other arm, which is approximately parallel with the first, formed by the part which carries the cutting tip 3. The free end face of the side wall 8 of the pick holder, which forms the boundary of the lateral opening 6 for the cutting pick, provides a supporting surface 17 against which the rear face 18 of the pick 2, when in place in the pick holder 1, bears, so that the cutting forces acting on the pick 3 during operation of the plough are transmitted to the supporting surface 17. As is shown especially by FIG. 2, the supporting surface 17 and the rear face 18 are formed as angled faces which lie in the same plane and extend transversely across the cutting direction S, with the supporting surface 17 on the side-wall 8 of the pick holder 1 extending inwards as far as the recess 14 in the socket 7. As can be seen from FIGS. 2 to 6 in particular, and especially from FIG. 5, the inclined supporting surface 17 on the end face of the side wall 8 of the pick holder 1 is formed by the inwardly converging flanks 17' of a V-groove in the free end face of the side wall 8, while the rear face 18 of the shank of the pick is formed as a tongue matching this V-groove so that when engaged in the latter its two rearwardly converging rear faces 18' are in full-face contact with the V-groove flanks 17'. This configuration of the supporting and rear faces 17, 18 yields a relatively large area of supporting surfaces between pick and pick holder, so that the working forces acting on the cutting tip 3 when the plough is in operation are safely transmitted to the pick holder without excessive pressure per unit of area.

The socket 7 of the pick holder 1 has bearing and guiding surfaces for the pick shank 5 which extend at an oblique angle to a plane parallel with the working face (shown by the arrow S), so that when the pick is removed from the lead-through opening 13 in the opposite direction to its insertion direction X, its cutting tip 3 is constrained to move away from the working face, thus further facilitating the removal of the pick 2 from the pick holder 1 when replacement is necessary. In the illustrated embodiment this angled guidance is obtained by inclining the axis of the pocket-form recess 14 and its bounding inner wall surfaces 8' and 9' at an oblique angle $\alpha$ to the cutting direction S, towards the front-end lead-through opening 13, and by inclining the axis of the supporting and guiding extension 15 of the pick shank 5 at the same angle, so that when the pick 2 is inserted into the holder 1 the supporting and guiding extension 15 is guided in the inclined socket recess 14 in the direction of the arrow X, causing the projecting cutting tip 3 of the pick to approach the working face; conversely, on withdrawal of the pick 2 from the holder 1 it is guided outwards at an angle in the opposite direction to the arrow X, so that the pick cutting tip 3 is thereby moved away from the working or coal face by an amount which is determined by the value of the angle $\alpha$. The angle $\alpha$ conveniently lies within the range of 5° to 10°, but may be made somewhat larger.

The abovementioned rear supporting and guiding extension 15 on the shank of the pick 2 and the pocket recess 14 in which it is held in a form-fitting manner with play may have various cross-sections, for example a rectangular cross-section, or alternatively a circular, semicircular or flattened segmental cross-section.

Figure 10:
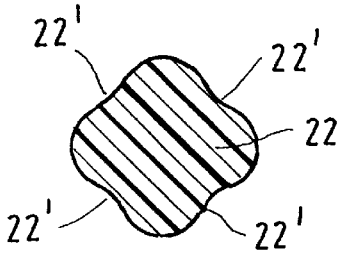
FIG. 10 shows a cross-section on Line X—X of FIG. 7 through the elastic retaining plug permanently attached to the securing element.

To secure the pick 2 in its inserted and working position in the pick holder 1, securing means are provided in both illustrated embodiments of the invention to stop the pick 2 from coming out of the socket 7 of the pick holder 1 via the lead-through opening 13 in the opposite direction to the insertion direction X when the plough is in operation when the plough executes its working motion in the opposite direction to the cutting direction of the pick, indicated in the drawing by the arrow S. In both of the illustrated embodiments, the securing means are arranged on the pick 2 in a captive manner, and together with the pick form a single component for insertion into the pick holder. In FIGS. 7 to 10 the securing means of the first embodiment are shown detached from the pick, while FIGS. 2, 3 and 6 show the securing means mounted on the pick. As is shown especially by FIGS. 2 and 6, there is a corner recess 19 at the front end of the shank 5 of the pick 2, in front of its tenon-like supporting and guiding extension 15 and behind that part of the shank which carries the cutting tip 3. The securing means are located in this recess 19, which is open towards the lead-through opening 13. The securing element 20 of the securing means is a snap-in latch element which is elastically deflectable from the position shown in FIG. 2, where it is latched on a fixed locking shoulder 21 located on the rear side wall 9 in the region of the pick insertion opening 13 and projecting into the socket 7 and across the recess 19, to the unlocked position, and vice versa. The securing element 20 is permanently fixed by a spigot 23 to an elastically deformable retaining plug 22 made of rubber or of an elastic synthetic material which is held in a blind hole 24 in the front face of the shank 5, or of its supporting and guiding extension 15, and which, as can be seen from FIG. 10, is provided on its outer circumference with a wavy concave-convex or sinuate surface 22' to increase its elastic deformability. The actual latch element of the securing element 20 is carried on a cylindrical connector 25 permanently joined by the spigot 23 to the retaining plug 22, and is formed by a locking bar 26 extending transversely to the direction X of insertion of the pick 2, and a lock guide piece 27 fixed at the centre of, and projecting transversely from, the locking bar 26, which projects beyond the lock guide piece 27 on either side of the guide piece. The complete securing element 20 with its parts 25, 26 and 27 is conveniently formed as a single metal unit. As is shown especially by FIGS. 7 and 8, the retaining plug 22 may have in its forward part a sealing lip 22" which seals off the blind hole 24 at its open end. In this case, the portion of the plug which lies in front of the sealing lip 22" may be formed as a smooth cylinder, while the portion of the plug which engages in the blind hole 24 has the abovementioned sinuate profile 22'.

As can be seen mainly from FIG. 1, the locking part at the front end of the pick holder, formed by the locking shoulder 21, and designed to function in conjunction with the pick securing element 20, has two opposed locking arms 28 spaced apart from each other, and permanently joined to the front end of the rear side wall 9 of the pick holder, the distance between them being slightly greater than the width of the lock guide piece 27.

Figure 11:
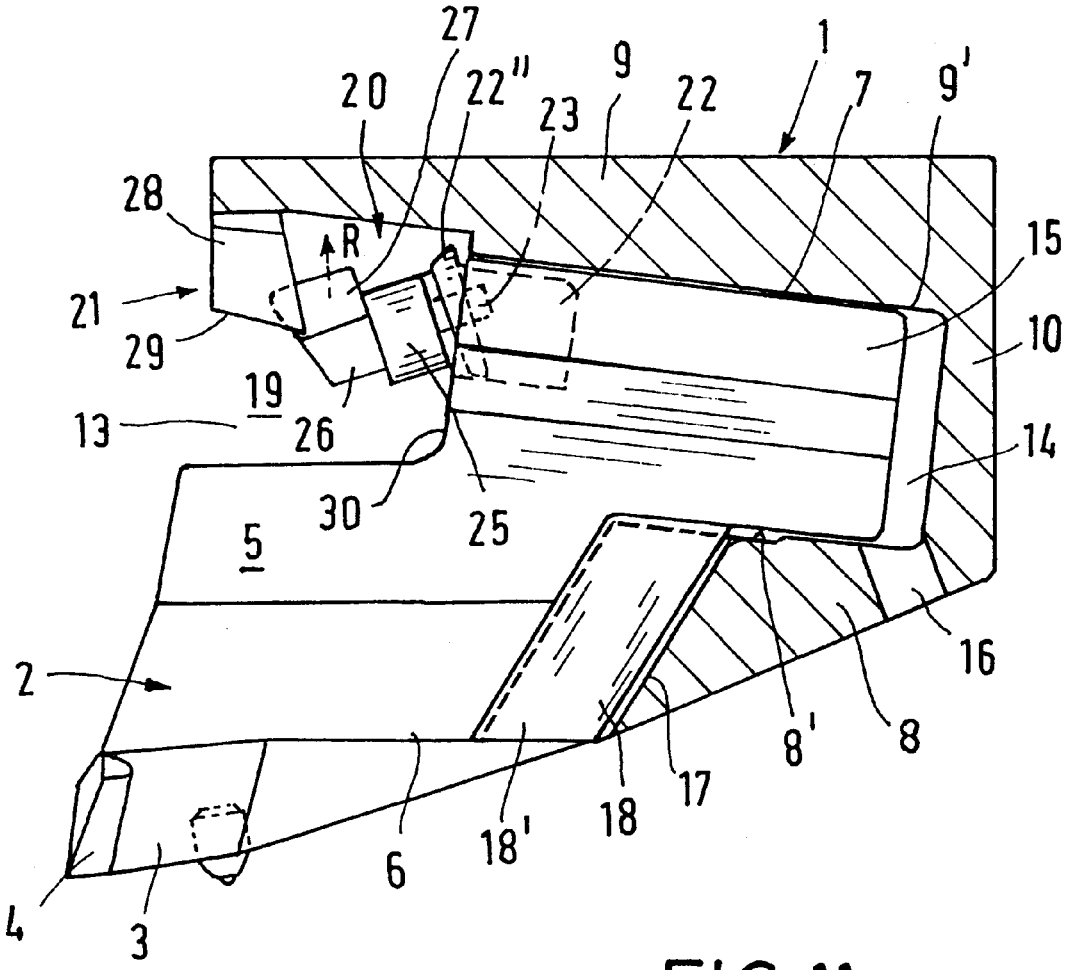
FIG. 11 shows, in the same sectional view as FIG. 2, the deflection of the securing element upon insertion of the pick into the socket in the pick holder.

FIGS. 1, 6 and 11 show the mode of operation of the pick securing means on insertion of the pick 2 into the pick holder in the insertion direction X. As can be seen especially from FIG. 6, the lock guide piece 27 directed towards the inner side-wall portion 9 of the pick holder slips through the guide opening formed between the two clawlike locking arms 28, while the locking bar 26, being wider, abuts against the wedge-shaped sloping outer pressure faces 29 of the two parallel locking arms 28 and—as FIG. 11 shows—is thereupon deflected sideways into the pick recess 19 by the ramming force with which the pick is inserted into the socket, with elastic deformation of the retaining plug 22. As the pick 2 is driven further into the socket 7 in the pick holder 1, the elastic restoring force of the retaining plug 22 causes the locking bar 26 to latch behind the locking arms 28 in the direction of the arrow R in FIG. 11 as soon as the lock guide piece 27 emerges rearwards from the guide opening between the locking arms 28. The locked position, in which the pick 2 inserted in the holder 1 is reliably secured in its working position, is shown in FIG. 2, and is also indicated in FIG. 3 where the locking bar 26, is shown in broken lines. It can also be seen that in the locked position the edge of the lock guide piece 27, which is shaped like the tip of a wedge 27', engages in a locking recess in the inner wall surface of the side-wall 9.

Release for the purpose of pick replacement can readily be effected with the aid of a simple tool like e.g. a lever or screwdriver, which is used to force the securing element 20 from the locked position shown in FIG. 2 to the deflected position shown in FIG. 11, in which, following elastic deformation of the retaining plug 22, the lock has been released, and the pick 2 can be withdrawn from the pick holder in the opposite direction to the insertion direction X. As this happens the locking bar 26 slides back over the wedge-shaped sloping outer pressure faces 29 of the locking arms 28. Obviously, the locking arms 28, which are fixed, are so disposed in the region of the pick lead-through opening 13 as not to hinder removal of the pick 2 when the lock is released. This can be brought about by locating the locking arms 28 at a distance in front of the end face 30 of the shank carrying the securing means with the retaining plug which is greater than the depth of insertion of the supporting and guiding extension 15 into the pocket recess 14. When in the course of the removal of the pick 2 the supporting and guiding extension 15 moves clear of the recess 14 in the pick holder, the pick can be turned in its socket sufficiently to allow it to be withdrawn from the lead-through opening 13 in the opposite direction to the arrow X.

In an alternative arrangement, the pick 2 can be fully withdrawn from the pick holder 1 in the opposite direction to the arrow X after its lock is released (FIG. 11), the rear supporting and guiding extension 15 of the pick shank 5, being dimensioned so that the shank can be withdrawn from the socket 7 of the holder moving through the guide opening between the two spaced apart locking arms 28. To facilitate the release of the lock with the aid of the lever tool, it is advisable to provide the lock guide piece 27—as shown especially in FIGS. 6 to 8—with a small recess 27" or the like into which the lever tool can be inserted in order to force the locking bar 26 into the unlocked position shown in FIG. 11 against the elastic restoring force of the retaining plug, in which position the pick can then be removed from the pick holder 1.

Figure 12:
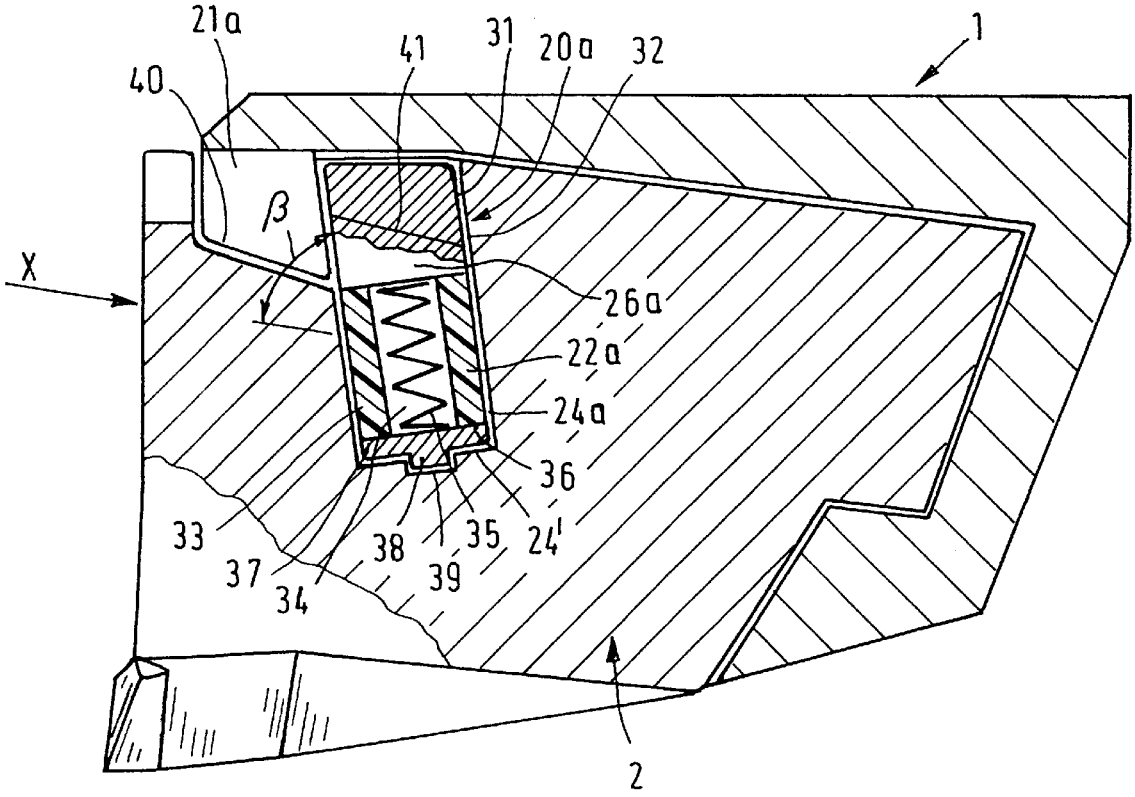
FIG. 12 shows a further embodiment of a plough pick system according to the invention, in a similar sectional plane to that of FIG. 2.

In the second embodiment of the pick system according to the invention shown in FIG. 12, a securing element **20*a* is not disposed more or less parallel with the direction of insertion X of the pick 2 as in the first embodiment, but is accommodated, with play, in a blind hole 24*a* in the pick approximately at right angles, or at an oblique angle β, to the insertion direction X. As in the first embodiment, the securing element 20*a* essentially consists of a snap-in latch element which, by means of a locking bar 26*a*, latches behind the locking shoulder 21*a* on the pick holder 1 when the pick 2 is inserted in the socket 7**.

The securing element (i.e. the latch element) has an inclined face 31 bearing against and slidable along a guide surface 32 formed on the pick 2, or its locking shoulder **21*a*, during assembly of the pick in the holder. As can be seen from the drawing, the securing element 20*a* formed as a latch element is arranged on an elastically deformable retaining plug 22*a* accommodated in a blind hole 24*a* in the shank of the pick 2 at the oblique angle β to the pick insertion direction X. The ramming force applied to the pick 2 on its insertion into the socket 7 of the pick holder 1, which displaces the securing element 20*a* as it rides over the locking shoulder 21*a* comprises the retaining plug elastically, so that when the pick is in the inserted position the retaining plug relaxes and the elastic restoring force places the securing element in the locked position behind the locking shoulder 21*a***, as depicted in the drawing.

In the illustrated embodiment the retaining plug **22*a* consists of a high-resistance foam cylinder 33 with a hollow bore 34 coaxial with its compression direction which accommodates a helical compression spring assisting the restoring action of the securing element 20*a*. On the end 36 opposite the securing element, the retaining plug 22*a* is provided with a cover plate 37 engaging by a spigot 38 in a seat 39, adapted to receive the spigot 38, in the bottom 24'** of the blind hole.

In the illustrated second embodiment, the locking shoulder has a sloping upper ramp surface 40, while the locking bar **26*a* forms a sloping lower surface which can slide along the ramp surface on assembly or removal of the pick, causing the securing element to be axially displaced inside the blind hole against the spring action of the elastically deformable retaining plug 22*a***. The sloping ramp surface and the sloping sliding surface co-operating therewith are inclined at an angle of approximately 5° to the insertion direction X, with the result that the forces exerted on the pick in the insertion direction X when the pick is driven into the socket are efficiently converted into the axial force necessary for compression of the retaining plug.

In other respects the construction of the pick system of the second embodiment corresponds to that of the first embodiment, and reference is therefore made to the detailed description given with reference to FIGS. 1 to 11.

The invention is of course not limited to the embodiments described above and illustrated in the drawing by way of example. Indeed, it is possible to modify it in various ways within the scope of the invention. This particularly applies to the securing of the pick in the pick holder, for which other securing elements may be used, including those which are introduced as separate loose parts after the pick has been inserted into the holder. In this case, fastening elements which are known for these purposes, such as e.g. locking pins and retaining keys and screws, etc., may also be provided as securing means, although the use of securing elements permanently attached to the pick offers particular advantages in handling. What is important is that the pick holder is designed so that the pick can be inserted into the socket in the pick holder, and taken out again in the opposite direction after the lock has been released, when replacement of the pick is necessary, through the pick lead-through opening 13 located at the leading end (i.e. leading in the working direction of the pick). It is also a significant feature of the invention that, as has been described, the pick and specifically its projecting cutting tip 3 is constrained by the co-operating guide surfaces between pick shank and socket to move a certain distance away from the working (coal) face when the pick is removed from the pick holder. Once inserted, the pick is of course held in the pick holder with an interference fit and is reliably secured against detachment from the holder regardless of the type of pick securing means adopted for the pick arrangement according to the invention. As FIG. 1 shows, the upper and lower wall parts 11 and 12 of the pick holder 1 may also be constructed so that they do not extend over the entire length of the holder, but terminate some way before the pick lead-through opening 13 and the inner side-wall 10.

What is claimed is:

1. A pick system for a mining plough comprising: at least one pick holder and at least one plough pick replaceably insertable in said holder, said holder having a working side confronting a mining face to be worked by said pick, a socket in said holder for releasably holding said pick with an interference fit, and an end stop for said pick, said pick comprising a shank insertable in said socket and a cutting tip extending from said shank to project from said working side of said holder, said holder and said pick being displaceable in operation in an operating direction transverse to said working side of said holder for working the mining face, and said holder having a leading face leading in said operating direction, said leading face having a lead-through opening through which said shank of said pick is insertable in an insert direction generally parallel to said working side until said shank engages said end stop, said pick also being removable from said socket through said lead-through opening in a direction opposite to said insert direction, and, releasable securing means for securing said pick against detachment when said pick has been inserted in said socket.

2. The pick system according to claim 1, wherein said lead-through opening extends into said working side of said holder and sad cutting tip projects beyond said working side.

3. The pick system according to claim 1, wherein said shank has a rear supporting and guiding extension and said socket has a recess for engagement with said extension to hold said shank in a form-fitting manner.

4. The pick system according to claim 3, wherein said socket recess has a fines discharge opening in the rear region therein.

5. The pick system according to claim 3, wherein said holder has an end face forming a rear boundary of said lead-through opening for said cutting tip of said pick and said end face provides said end stop and a rear face of said pick bears against said end stop, said end face of said holder extending inwardly as far as said recess in said socket.

6. The pick system according to claim 3, wherein said pick is approximately S-shaped having a first arm which forms said supporting and guiding extension and a second arm from which said cutting tip extends.

7. The pick system according to claim 3, wherein at least one of said pick shank and said supporting and guiding extension is tapered from its front part towards its rear end.

8. The pick system according to claim 7, wherein said supporting and guiding extension is trapezoidally tapered.

9. The pick system according to claim 1, wherein said holder has an end face forming a rear boundary of said lead-through opening for said cutting tip of said pick and said end face provides said end stop and a rear face of said pick bears against said end stop.

10. The pick system according to claim 9, wherein said end face including inwardly covering flanks of a V-groove, said rear face of said pick being shaped to matingly engage said V-groove and having inclined flanks covering towards said cutting tip.

11. The pick system according to claim 1, wherein said securing means comprises a captive securing element on said pick, said securing element and said pick forming a single component for insertion into said holder.

12. The pick system according to claim 11, wherein said lead-through opening of said holder includes a locking element comprising a locking shoulder which interengages with said securing element when said pick is inserted into said socket to secure said pick in said socket.

13. A pick system for a mining plough comprising: at least one pick holder and at least one plough pick replaceably insertable in said holder, said holder having a working side confronting a mining face to be worked by said pick, a socket in said holder for releasably holding said pick with an interference fit, and an end stop for said pick, said pick comprising a shank insertable in said socket and a cutting tip extending from said shank to project from said working side of said holder, said holder and said pick being displaceable in operation in an operating direction transverse to said working side of said holder for working the mining face, and said holder having a leading face leading in said operating direction, said leading face having a lead-through opening through which said shank of said pick is insertable in an insert direction generally parallel to said working side until said shank engages said end stop, said pick also being removable from said socket through said lead-through opening in a direction opposite to said insert direction, releasable securing means for securing said pick against detachment when said pick has been inserted in said socket, and said socket in said holder has at least one bearing and guiding surface for said shank which is inclined at an oblique angle relative to said operating direction so that when said pick is removed from said lead-through opening said cutting tip of said pick is moved away from the mining face.

14. The pick system according to claim 13, wherein said shank has a side face guided by said at least one bearing and guiding surface on insertion and removal of said pick through said lead-through opening, said at least one bearing and guiding surface and said shank side face being inclined at an oblique angle between 5° and 20° to said operating direction.

15. The pick system according to claim 14, wherein said oblique angle is between 5° and 10°.

16. The pick system according to claim 14, wherein said shank has a rear supporting and guiding extension and said socket has a recess for engagement with said extension to hold said shank in a form fitting manner, said recess and said extension being aligned on an axis inclined at said oblique angle relative to said operating direction.

17. A pick system for a mining plough comprising: at least one pick holder and at least one plough pick replaceably insertable in said holder, said holder having a working side confronting a mining face to be worked by said pick, a socket in said holder for releasably holding said pick with an interference fit, and an end stop for said pick, said pick comprising a shank insertable in said socket and a cutting tip extending from said shank to project from said working side of said holder, said holder and said pick being displaceable in operation in an operating direction transverse to said working side of said holder for working the mining face, and said holder having a leading face leading in said operating direction, said leading face having a lead-through opening through which said shank of said pick is insertable in an insert direction generally parallel to said working side until said shank engages said end stop, said pick also being removable from said socket through said lead-through opening in a direction opposite to said insert direction, releasable securing means for securing said pick against detachment when said pick has been inserted in said socket, and said holder has an end face forming a rear boundary of said lead-through opening for said cutting tip of said pick and said end face provides said end stop and a rear face of said pick bears against said end stop, and said end and rear faces are formed as angled faces which lie in the same plane and extend at an oblique angle relative to said operating direction.

18. A pick system for a mining plough comprising: at least one pick holder and at least one plough pick replaceably insertable in said holder, said holder having a working side confronting a mining face to be worked by said pick, a socket in said holder for releasably holding said pick with an interference fit, and an end stop for said pick, said pick comprising a shank insertable in said socket and a cutting tip extending from said shank to project from said working side of said holder, said holder and said pick being displaceable in operation in an operating, direction transverse to said working side of said holder for working the mining face, and said holder having a leading face leading in said operating direction, said leading face having a lead-through opening through which said shank of said pick is insertable in an insert direction generally parallel to said working side until said shank engages said end stop, said pick also being removable from said socket through said lead-through opening in a direction opposite to said insert direction, releasable securing means for securing said pick against detachment when said pick has been inserted in said socket, and said securing means comprises a captive securing element on said pick, said securing element and said pick forming a single component for insertion into said holder, said lead-through opening of said holder includes a locking element comprising a locking shoulder which interengages with said securing element when said pick is inserted into said socket to secure said pick in said socket, said securing element comprises a snap-in latch element that is elastically deflectable between a latched position in which said latch element is latched on said locking element and an unlatched position.

19. The pick system according to claim 18, further comprising a blind hole in a front face of said pick shank and an elastically deformable retaining plug therein, said snap-in latch element being arranged on said retaining plug such that said retaining plug allows said elastic deflection of said snap-in latch element when said pick is inserted into said socket in said holder, said elastic deflection being lateral deflection of said snap-in latch element between said latched position and said unlatched position thereby allowing said snap-in latch element to deflect past said locking element and then deflect to said latched position behind said locking element by the elastic restoring force of the retainer plug when said pick is fully inserted.

20. The pick system according to claim 19, wherein a spigot is provided on said snap-in latch element for fastening said snap-in latch element to said retaining plug.

21. The pick system according to claim 19, wherein said retaining plug has an outer circumference formed with a sinuate surface.

22. The pick system according to claim 19, wherein said retaining plug is made of high-resistant foam.

23. The pick system according to claim 19, wherein said retaining plug includes a helical compression spring.

24. The pick system according to claim 23, wherein said retaining plug has an axis of compression and has a hollow bore coaxial with said compression axis said helical compression spring being within said hollow bore.

25. The pick system according to claim 19, further comprising a cover plate on the end of said retaining plug opposite said securing element, and a spigot on said cover plate for interengagement with a blind hole in said retaining plug.

26. The pick system according to claim 19, wherein an inner side-wall of said holder has said locking element permanently joined thereto, and said locking element comprises two fixed locking arms having a gap therebetween, said securing element comprising a locking bar extending transversely to the direction of insertion of said pick, and a locking guide piece projecting transversely to said locking bar, said locking guide piece being arranged to pass through said gap between said locking arms when said pick is inserted into said socket and, as said retaining plug deforms elastically, said locking bar being arranged to ride over said locking arms and snap into said latched position in which it latches behind said locking arms.

27. The pick system according to claim 26, wherein said locking element forms a sloping upper ramp surface and said locking bar forms a sloping lower ramp surface for sliding on said upper ramp surface when said pick is inserted in said socket.

28. The pick system according to claim 27, wherein said sloping upper surface and said sloping lower surface are inclined at an angle of approximately 5° to 20° to the insertion direction.

29. The pick system according to claim 19, wherein said retaining plug includes a sealing lip for sealing off said blind hole.

30. The pick system according to claim 18, further comprising a spring action on said snap-in latch element for deflecting said snap-in latch element into said latched position behind sad locking element when sad pick is inserted into said socket.

31. The pick system according to claim 18, wherein mutually contacting inclined faces are provided on said snap-in latch element and said pick for sliding guidance of said elastic deflection of said snap-in latch element.

32. The pick system according to claim 18, further comprising a blind hole in said shank transverse to said pick insertion direction, and an elastically deformable retaining plug accommodated in said blind hole, said snap-in latch element being arranged on said retaining plug and said locking element being engageable by said snap-in latch element, said retaining plug being elastically compressible when said pick is inserted into said socket of said holder so that said snap-in latch element can pass said locking element, when said pick is in the inserted position said securing element is located in said latched position behind said locking element by virtue of the elastic restoring force of said retaining plug.

33. A pick system for a mining plough comprising: at least one pick holder and at least one plough pick replaceably insertable in said holder, said holder having a working side confronting a mining face to be worked by said pick, a socket in said holder for releasably holding said pick with an interference fit, and an end stop for said pick, said pick comprising a shank insertable in said socket and a cutting tip extending from said shank to project from said working side of said holder, said holder and said pick being displaceable in operation in an operating direction transverse to said working side of said holder for working the mining face, and said holder having a leading face leading in said operating direction, said leading face having a lead-through opening through which said shank of said pick is insertable in an insert direction generally parallel to said working side until said shank engages said end stop, said pick also being removable from said socket through said lead-through opening in a direction opposite to said insert direction, releasable securing means for securing said pick against detachment when said pick has been inserted in said socket, and said securing means comprises a captive securing element on said pick, said securing element and said pick forming a single component for insertion into said holder, said securing element is displaceably arranged on said pick approximately at right-angles or obtuse angles relative to the insertion direction of said pick into said lead-through opening.

34. A pick system for a mining plough comprising: at least one pick holder and at least one plough pick replaceably insertable in said holder, said holder having a working side confronting a mining face to be worked by said pick, a socket in said holder for releasably holding said pick with an interference fit, and an end stop for said pick, said pick comprising a shank insertable in said socket and a cutting tip extending from said shank to project from said working side of said holder, said holder and said pick being displaceable in operation in an operating direction transverse to said working side of said holder for working the mining face, and said holder having a leading face leading in said operating direction, said leading face having a lead-through opening through which said shank of said pick is insertable in an insert direction generally parallel to said working side until said shank engages said end stop. said pick also being removable from said socket through said lead-through opening in a direction opposite to said insert direction, releasable securing means for securing said pick against detachment when said pick has been inserted in said socket, said securing means comprises a captive securing element on said pick, said securing element and said pick forming a single component for insertion into said holder, said lead-through opening of said holder includes a locking element comprising a locking shoulder which interengages with said securing element when said pick is inserted into said socket to secure said pick in said socket, and said shank including a supporting and guiding extension for engagement with said socket, said supporting and guiding extension having a front surface facing said operating direction, an end face opposite to said front surface and a recess formed between said front surface and said end surface, said recess accommodating said securing element, and said locking element on said holder projecting into said recess.

* * * * *